US006431374B1

(12) United States Patent
Winikoff

(10) Patent No.: US 6,431,374 B1
(45) Date of Patent: Aug. 13, 2002

(54) DISPLAY UNIT

(76) Inventor: Robert Winikoff, 7915 Cote Ste Luc Rd. Apt. 606, Cote Ste Luc Québec (CA), H4W 1R4

( * ) Notice: Subject to any disclaimer, the term of this patent is extended or adjusted under 35 U.S.C. 154(b) by 0 days.

(21) Appl. No.: 09/380,309

(22) PCT Filed: Sep. 13, 1998

(86) PCT No.: PCT/CA98/00888

§ 371 (c)(1),
(2), (4) Date: Aug. 30, 1999

(87) PCT Pub. No.: WO99/15054

PCT Pub. Date: Apr. 1, 1999

(30) Foreign Application Priority Data

Sep. 19, 1997 (CA) ..... 2215823

(51) Int. Cl.[7] ..... A47F 5/08

(52) U.S. Cl. ..... 211/87.01; 211/105.1; 211/204

(58) Field of Search ..... 211/87.01, 105.1, 211/204, 166, 165, 74

(56) References Cited

U.S. PATENT DOCUMENTS

| | | | | | |
|---|---|---|---|---|---|
| 1,482,649 | A | * | 2/1924 | Hayden | 211/87.01 |
| 1,677,764 | A | * | 7/1928 | Gloekler | 211/105.1 |
| 2,076,522 | A | * | 4/1937 | Anderson | 211/163 |
| 2,665,011 | A | * | 1/1954 | Simjian | 211/99 |
| 3,119,497 | A | * | 1/1964 | Levy | 211/178 |
| 3,807,574 | A | * | 4/1974 | Lanza | 211/176 |
| 4,162,015 | A | * | 7/1979 | Hodges | 211/87.01 |
| 4,181,230 | A | * | 1/1980 | Acuff | 211/208 |
| 4,253,578 | A | * | 3/1981 | Rekow | 211/208 |
| 4,351,441 | A | | 9/1982 | Schramm | |
| 4,361,241 | A | | 11/1982 | Stoddard | |
| 4,380,298 | A | | 4/1983 | Harig | |
| 4,474,299 | A | * | 10/1984 | Andrews | 211/193 |
| 4,508,231 | A | | 4/1985 | Honickman | |
| 4,548,328 | A | | 10/1985 | Brauning | |
| 4,655,354 | A | * | 4/1987 | Cohen | 211/199 |
| 4,813,552 | A | | 3/1989 | Walter | |
| 4,878,586 | A | * | 11/1989 | Bancroft et al. | 211/106 |
| 4,890,749 | A | * | 1/1990 | Walter | 211/189 |
| 4,932,539 | A | | 6/1990 | Abinanti | |
| D312,737 | S | * | 12/1990 | Glassenberg | D6/415 |
| 5,016,764 | A | * | 5/1991 | Bauer | 211/189 |
| 5,020,759 | A | * | 6/1991 | Weber | 248/309.2 |
| D323,080 | S | * | 1/1992 | Allen | D6/411 |
| D325,887 | S | | 5/1992 | Vodhanel, Jr. | |
| 5,152,404 | A | * | 10/1992 | Salrin et al. | 211/46 |
| 5,332,108 | A | * | 7/1994 | Blass | 211/90 |
| 5,370,248 | A | | 12/1994 | Robolin | |
| 5,499,725 | A | * | 3/1996 | Palumbo | 211/105.1 |
| 5,833,081 | A | * | 11/1998 | Smith | 211/86.01 |
| 5,944,203 | A | * | 8/1999 | Vlah et al. | 211/189 |
| 6,053,460 | A | * | 4/2000 | Wilkinson, Jr. et al. | 248/122.1 |

* cited by examiner

*Primary Examiner*—Daniel P. Stodola
*Assistant Examiner*—Khoa Tran

(57) ABSTRACT

A display unit having a relatively long, straight, leg and a plurality of hanger arms extending from one side of the leg. The hanger arms are equally spaced apart and parallel to each other and extend at an acute angle to the leg. One end of the leg is connected to one end of a base, the base parallel to the hanger arms. There is an article support on each hanger arm, the article support extending transverse to the hanger arm. Articles to be displayed are hung on the article supports, the articles parallel with the hanger arms.

19 Claims, 5 Drawing Sheets

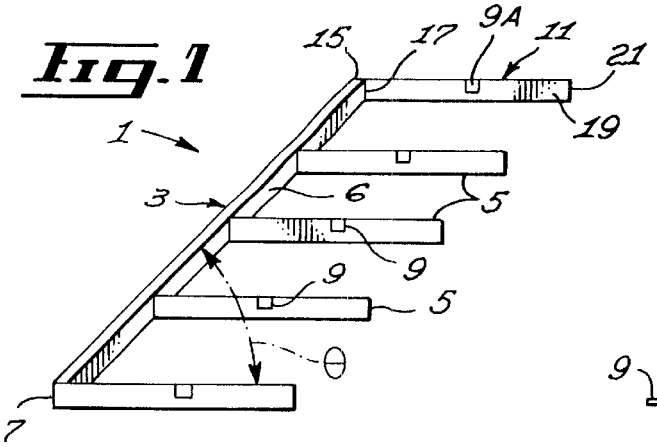
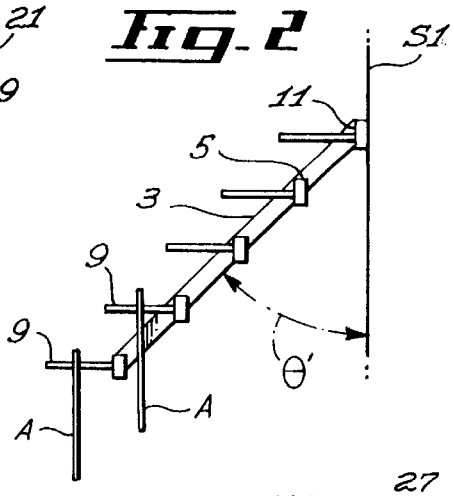
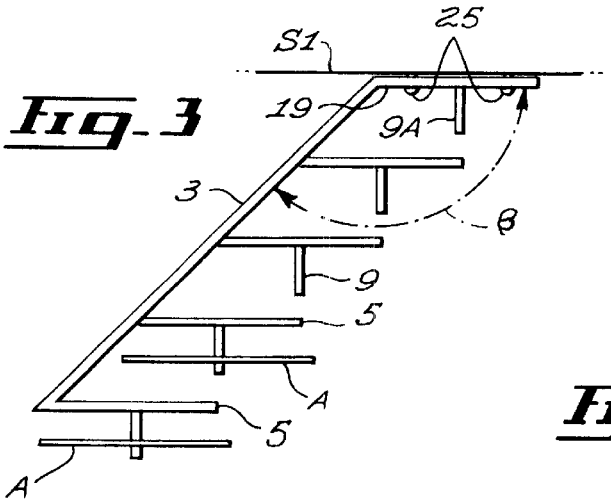
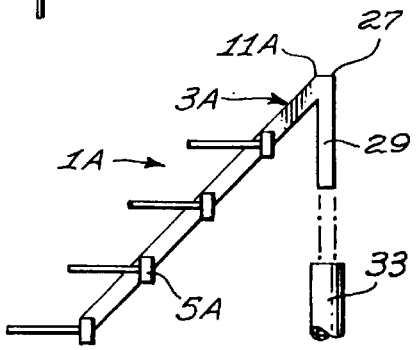
Fig. 4
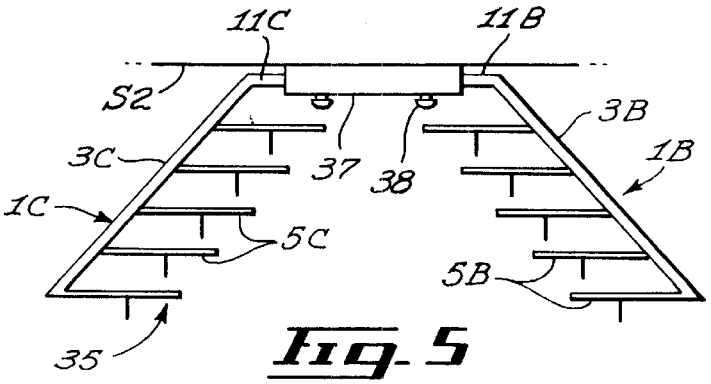
Fig. 5
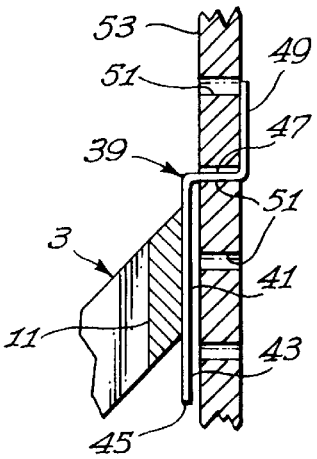
Fig. 6

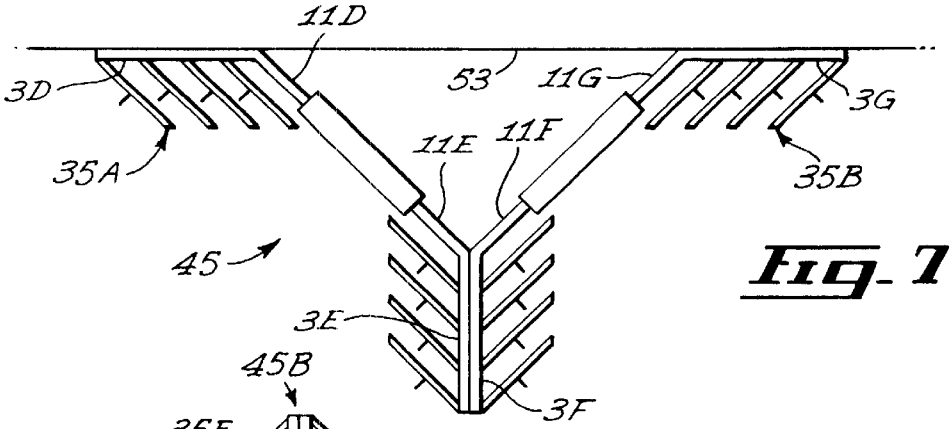
Fig. 7
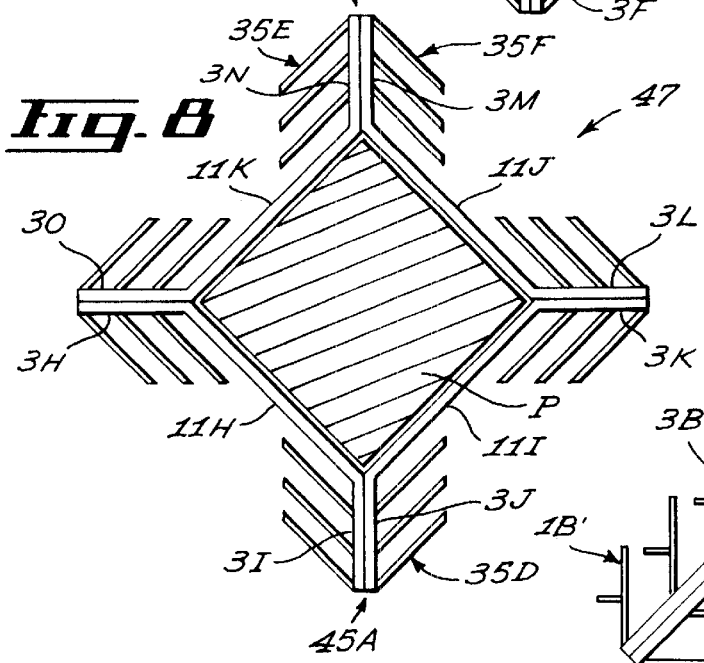
Fig. 8
Fig. 9
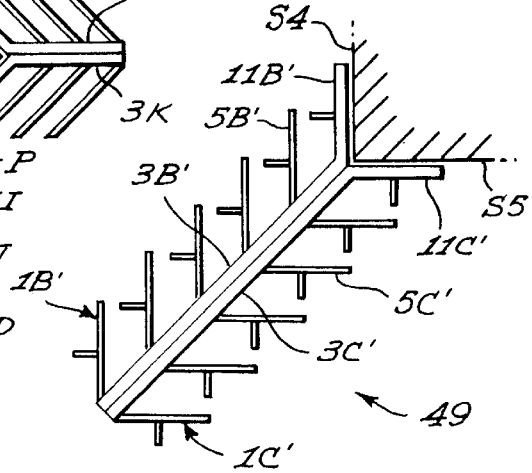
Fig. 10
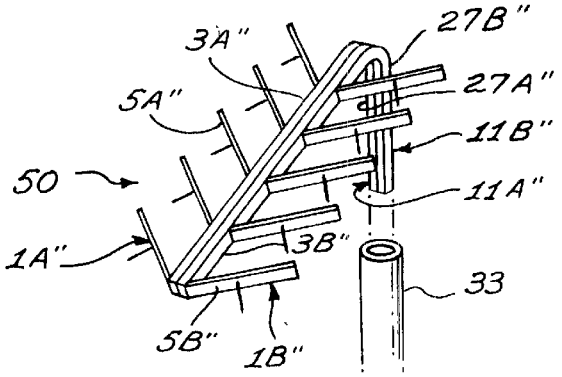
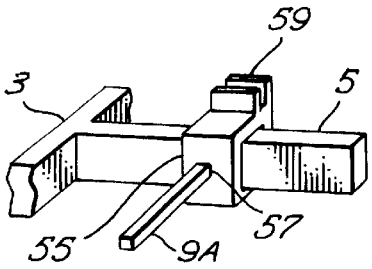
Fig. 11

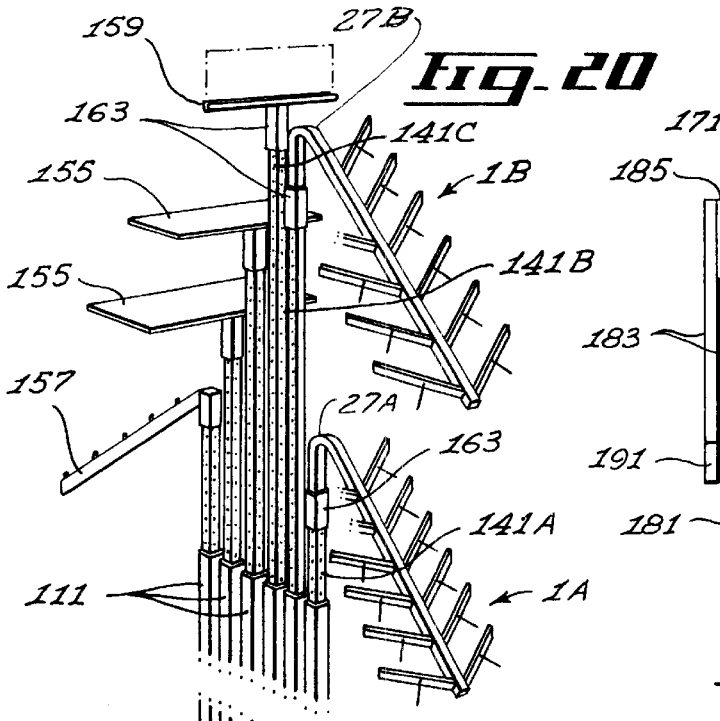
Fig. 20
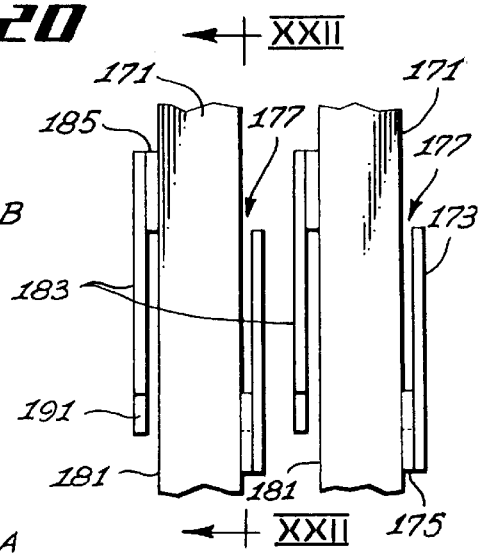
Fig. 21A
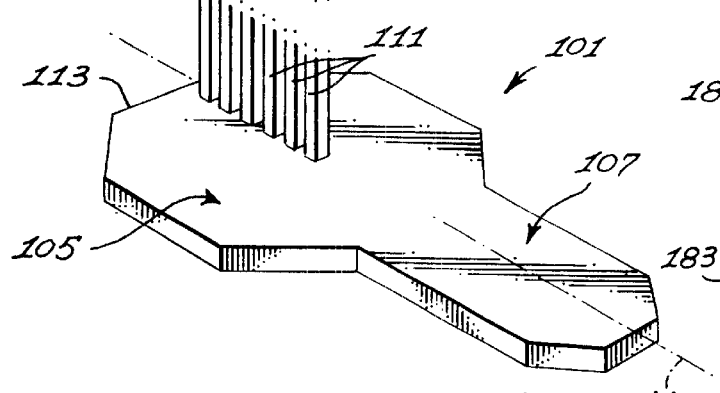
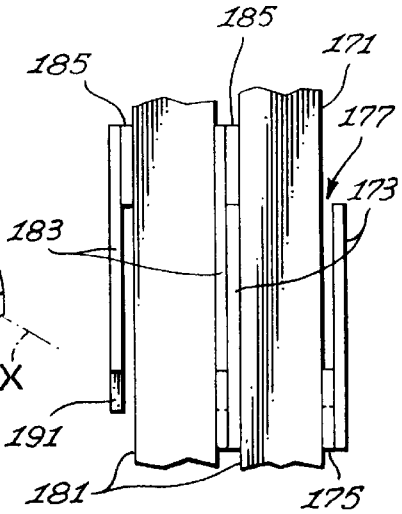
Fig. 21B
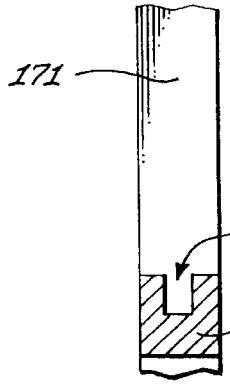
Fig. 22
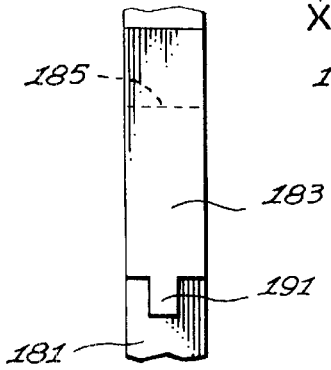
Fig. 23

DISPLAY UNIT

FIELD OF THE INVENTION

This invention is directed toward a display unit. The invention is more particularly directed toward a display unit of the type having one or more arms from which a plurality of articles to be displayed are hung.

The invention is also directed toward a display stand. The display stand is of the type having two or more support posts on a base for holding display units for supporting articles to be displayed and for supporting accessories.

The invention is further directed toward the combination of the display stand and the display unit

BACKGROUND ART

Known display units employ at least one arm that is mounted to extend horizontally from a vertical support such as a wall. The arm normally extends transversely to the wall. The articles to be displayed are all hung from their top end on the arm one behind the other. The arrangement however makes it difficult to determine how many articles are on the arm making inventory control difficult, particularly when there is another arm adjacent and parallel to the one arm. The arrangement also displays only one article at a time and if the articles differ, such as to color, it is difficult for the consumer to see the different colors. Further, with only the article at the front fully displayed, the known display unit does not provide a very attractive display.

It is also known to provide a display unit where one arm angles downwardly from a vertical support such as a wall, the arm extending transverse from the wall. The one arm has spaced apart stops on its top surface along its length to hold articles on the arm in spaced apart relation. This display unit vertically staggers the articles held making inventory control easier, and displaying more of the articles. However the display unit still does not display much of the articles and is not too attractive.

SUMMARY OF THE INVENTION

It is the purpose of the present invention to provide a display unit that displays the articles in a more attractive manner. It is another purpose of the present invention to provide a display unit that makes inventory control easier. It is a further purpose of the present invention to display more of each of the articles carried on the unit making it easier for the consumer to make a choice. It is a further purpose to provide a basic, novel, display unit, two or more of which can be combined in various ways to provide larger display units to display articles in different settings in more attractive ways.

In accordance with the present invention, there is provided a display unit having a single, straight, leg. The leg is in the form of a rigid bar and has a plurality of parallel hanger arms extending therefrom. The hanger arms extend in the same direction from one side of the leg, are equally spaced apart, and are parallel to each other. The hanger arms extend at an angle $\phi$ to the side of the leg section. This angle $\phi$ can be a right angle but preferably is an acute angle and more preferably is 45°. Each hanger arm has at least one article carrying member extending transversely therefrom for carrying at least one generally flat article generally parallel to the arm. The hanger arms on the display unit can be detachably mounted on the leg so that their size and/or number can be changed and so that the spacing between the hanger arms can be changed.

In one embodiment, the display unit has a base at one end of the leg that comprises a short bar. The base is attached at one end to the end of the leg and extends parallel to the hanger arms. The base extends from the bar in the same direction as the hanger arms. The leg is attached to the base in a such a manner so that when the base is horizontal with a long side facing front, the leg extends outwardly at an angle $\beta$ to the base, which angle is complementary to the angle $\phi$ at which the hanger arms extend from the leg. The leg also extends downwardly at an angle to the base when viewed from the front. If the leg is attached to the left side of the base when viewed from the front the leg normally extends outwardly and downwardly to the left. If the leg is attached to the right side of the base when viewed from the front, the leg normally extends outwardly and downwardly to the right. You therefore can have left or right handed, single-leg, display units.

The single-leg display unit is normally mounted on a flat vertical surface via the base with the base flat against the surface and horizontal. The display unit displays the articles in both vertically and laterally stepped relationship. Thus the unit displays the top portion and a side portion of each article on the unit. The arrangement makes it easier to see the colors and/or styles of the articles displayed. It also makes it easier to see how many articles are left on display. The staggered display makes it easier for the storekeeper to restock the display unit. And the staggered display presents the articles more attractively and thus more likely to sell.

The single-leg display unit could also be mounted in an inner corner, with the base mounted on one wall surface forming the corner, the leg extending across the corner at an angle to have its bottom end contact, or even be attached, to the other wall surface forming the corner.

While the single-leg display unit has been described with the base extending in the same direction as the hanger arms and parallel to them, the base could also extend in the opposite direction to the hanger arms but still be parallel to them.

In another embodiment, the base could be aligned with the leg but bent relative to the leg to extend vertically down instead of horizontally. The bent base can be mounted on a vertical post to mount the display unit on a post.

A number of single-leg display units can be employed in various combinations to provide different shapes of larger display units that display articles in attractive groupings in the same staggered relationship as displayed by a single-leg display unit. For example, a left hand, single-leg, display unit can be combined with a right hand, single-leg, display unit to form a diverging, two-leg, display unit. The two bases of the two, single-leg display units can be combined into one common base for the two-leg display unit. In this diverging, two-leg, display unit the two legs lie in the same plane, are spaced from each other, and diverge from each other, extending downwardly and outwardly from the common base when it is horizontal. The hanger arms on the two legs extend inwardly toward each other. This display unit is again normally mounted by its common base on a flat vertical surface with the base flat against the surface and horizontal. In another example, one right hand, single-leg display unit can be combined with a second left hand, single-leg display unit in back-to-back relationship, the hanger arms on both legs extending away from each other and at an angle to each other. Preferably, in this two-leg, back-to-back, display unit, the two single legs are combined into one common leg with the hanger arms on opposite sides extending in opposite directions from each other. This display unit, provided the angle β is 135°, can be mounted on an outer corner with one base on one wall surface forming the corner and the other base on the other wall surface forming the corner.

The diverging two-leg, display unit can be combined with a second diverging two-leg display unit to from a four-leg display unit provided the angle β is 135°. The adjacent legs of the two, two-leg units are joined together by suitable means with the bases of the two units at right angles to each other. This four-leg display unit is mounted to a wall surface by the other two legs which are aligned. Two such four-leg display units, each the same size, could be combined to extend about, and be mounted on, a square support. This is provided the base of each unit is as long as the width of the support. The two-leg, back-to-back, display unit can be mounted with the bases, or a common base, within a vertical tubular support post that is mounted on a stand. The multiple-leg display units can be adapted to be mounted on walls, pegboards, slat walls, turntables, or stands with supports for the display units.

A display stand is provided for the display units, particularly the display units having back-to-back legs. The display stand has an elongated base and at least two posts at one end of the base extending upright from the base. The two posts are preferably aligned with the longitudinal axis of the base. As many as six posts, or even more, could be provided all aligned with the longitudinal axis of the base. Suitable connecting mean are provided for detachably connecting the posts to the base and to each other. The back-to-back, two-leg, display units are mounted on the posts using adjustable height standards. The posts could also carry accessories associated with the articles displayed by the display units.

The invention is particularly directed toward a display unit having a relatively long, straight, leg and a plurality of hanger arms extending from one side of the leg, the hanger arms equally spaced apart and parallel to each other. The hanger arms extend at an acute angle to the leg. An article support is provided on each hanger arm, the article support extending transverse to the hanger arm.

The invention is also particularly directed toward a two-leg display unit having a relatively short base, a first relatively long, straight, leg extending from one end of the base and a second relatively long straight leg extending from the other end of the base. Both legs, when the base is horizontal and has a long side facing front, extend downwardly and outwardly from the base to diverge from each other. Each leg has a plurality of equally spaced apart, parallel, hanger arms extending from one side of the leg toward the other leg, the hanger arms parallel with the base.

The invention is further directed toward a display stand having an elongated base and a plurality of post mounting means on the base, the mounting means located adjacent one narrow end of the base. Each mounting means is used to mount a tubular, support post on the base. The stand has at least two support posts with connecting means for mounting the posts in an upright position on the mounting means on the base. A display unit is mounted on at least one of the posts to extend over the base toward the other narrow end of the base. One of a second display unit and an accessory unit is mounted on the second support post.

BRIEF DESCRIPTION OF THE FIGURES IN THE DRAWINGS

FIG. 1 is a front view of the display unit;

FIG. 2 is a side view of the display unit with some articles mounted thereon;

FIG. 3 is a top view of the display unit with some articles mounted thereon;

FIG. 4 is a side view of a variation of the single-leg display unit;

FIG. 5 is a top view of a larger display unit combining two-single-leg display units;

FIG. 6 is a side view, in partial section, of mounting means used to mount a display unit on a peg board.

FIG. 7 is top view of a larger display unit combining two, two-leg display units;

FIG. 8 is a top view of a larger display unit combining two, four leg display units;

FIG. 9 is a top view of a larger display unit combining two single leg units back to back;

FIG. 10 is a rear, perspective, view of another variation of a display unit;

Figure 11A:
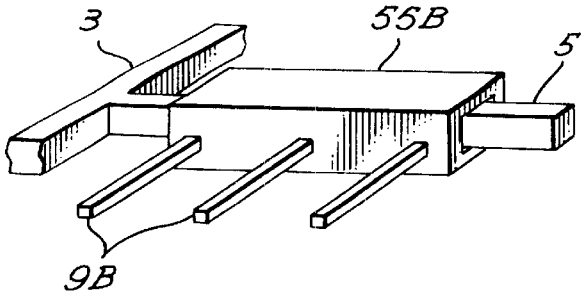
Figure 11B:
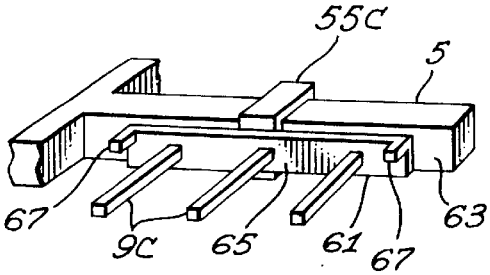
Figure 12:
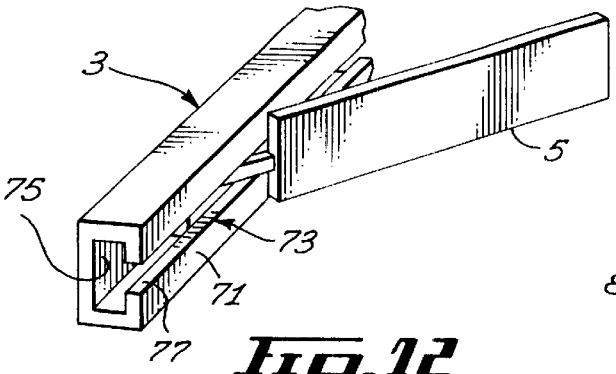
Figure 13:
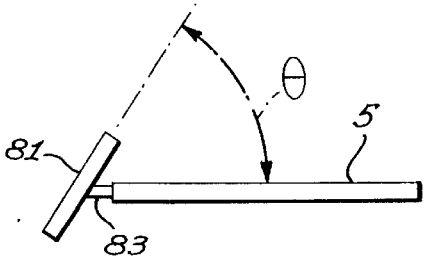
Figure 14:
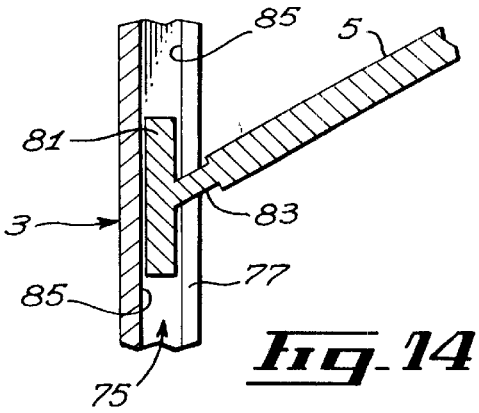
Figure 15:
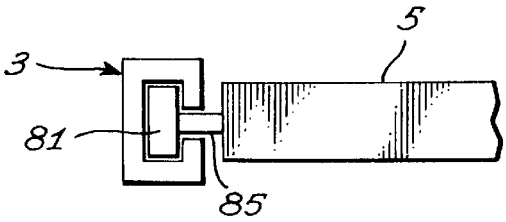
Figure 16:
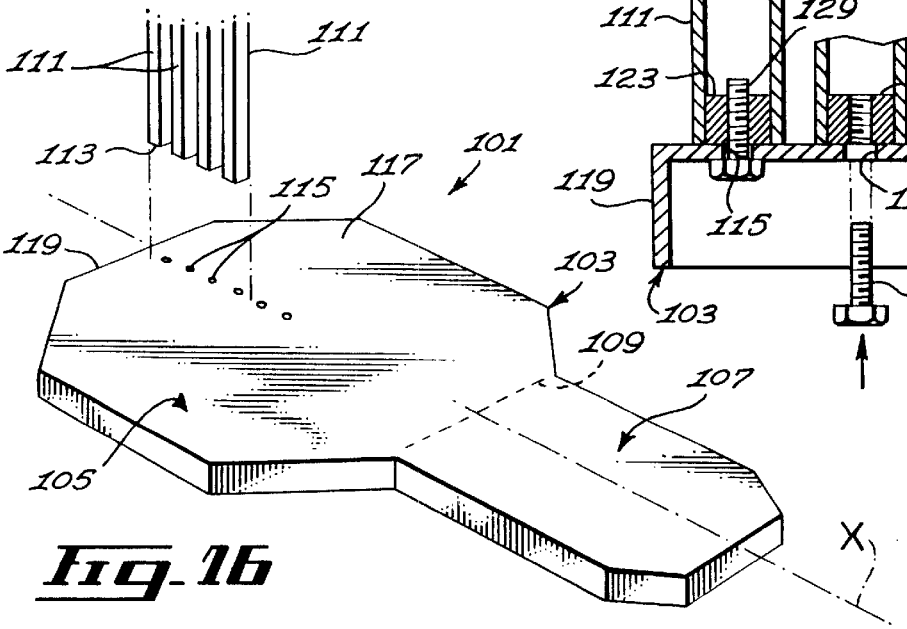
Figure 17:
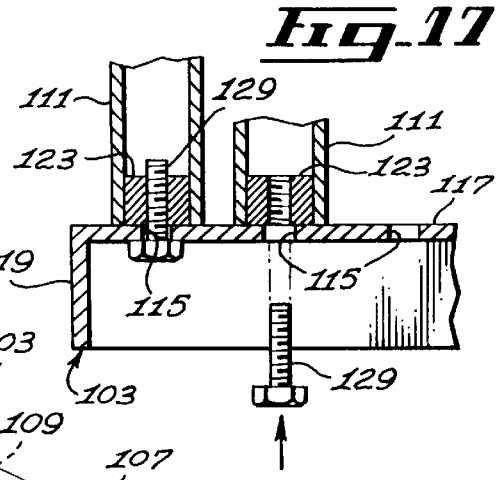
Figure 18:
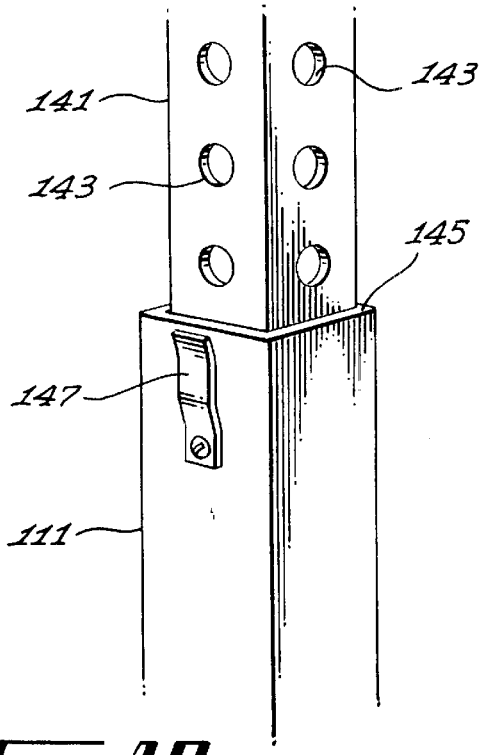
Figure 19:
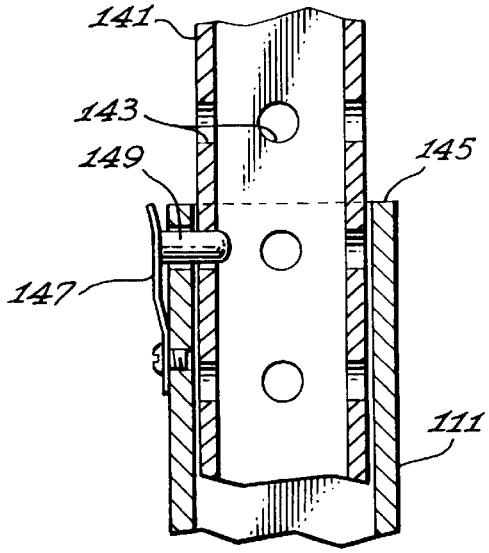

FIG. 11 perspective view of an adjustable article support;

FIG. 11A is a detail perspective view of another form of article support;

FIG. 11B is a detail perspective view of yet another form of article support;

FIG. 12 is a detail perspective view of the mounting means for adjustable arm;

FIG. 13 is a perspective view of the arm of FIG. 12;

FIG. 14 is a top, sectional detail view of the arm mounting;

FIG. 15 is an end view of the arm mounting;

FIG. 16 is a exploded perspective view of a display stand;

FIG. 17 is a detail cross-section view showing the attachment of the posts to the stand;

FIG. 18 a detail perspective view of a standard;

FIG. 19 is detail cross-section view showing locking of the standard in a post;

FIG. 20 is a perspective of the stand carrying display units and accessories;

FIGS. 21A and 21B are side detail views of two posts showing the connecting means on the posts, and the posts connected;

FIG. 22 is a cross-section view taken along line 22—22 in FIG. 21; and FIG. 23 is side view of the posts in FIG. 21.

DESCRIPTION OF THE PREFERRED EMBODIMENT OF THE INVENTION

The display unit 1 of the present invention, shown in FIGS. 1 and 3, has a straight leg 3 in the form of a bar. The leg 3 has a plurality of hanger arms 5 extending from one side 6 of the leg. The hanger arms 5 are preferably equally spaced apart on the leg 3, are parallel to each other, and extend at an acute angle ϕ to the leg 3. This angle ϕ preferably is 45° but it could range from 15° to 75°. The hanger arms 5 are also preferably of the same length. One hanger arm 5 preferably is located at the bottom end 7 of the leg 3. Each hanger arm 5 has an article support 9 for supporting an article A from the hanger arm 5 in a position generally parallel to the hanger arm as shown in FIG. 3. The article support 9 extends transversely from the hanger arm 5 and can comprise a short loop of wire fastened to the hanger arm 5. Instead of a wire loop, a single wire member, a small bar member, or the like, could form the article support. The free end of the article support 9 is preferably turned up slightly to maintain the article on the support. Alternatively, a small stop element (not shown) can be provided on the free end of the article support. The article support 9 can be long enough to hold more than one article.

The display unit 1 includes a base 11. The base 11 is preferably a straight short length of bar that is fastened to the top end 15 of the leg 3. Preferably, the base 11 is fastened at one end 17 to the end 15 of the leg 3 and extends from the leg in the same direction as do the hangers 5, and parallel to the hangers. The leg 3 is attached to the base 11 in a manner so that when the base 11 is horizontal and with a long side 19 of the base facing front, when viewing the front, the leg 3 extends downwardly and outwardly from the base 11. The leg 3 extends outwardly from the base 11 at an angle $\phi'$ which is complementary to the angle $\phi$. This angle $\phi'$ is preferably 135° but can range between 105° and 165°. The leg 3 also extends downwardly from the base 11 at an angle $\beta$ which is preferably 45° but can range between 15° and 75°.

It is noted that the leg 3 is attached to the left end 17 of the base 11 when viewing the unit from the front, and angles outwardly and downwardly to the left, to provide a left-hand unit. The leg 3 could also be attached to the other end 21 of the base 11 and could angle to the right of the base when viewing the base from the front to provide a right-hand unit. The base 11 is shown as extending in the same direction as the hangers 5. When the base 11 extends in the same direction as the hangers 5 it could also carry an article support 9A. However the base 11 could extend from the leg 3 in the opposite direction from the hangers 5 while still parallel to them.

The display unit 1 is adapted to be mounted on a vertical wall surface S1, as shown in FIGS. 2 and 3, with the base 11 against the wall surface S1 and horizontal. Screws 25 or other suitable fastening means can be used to fasten the base 11 to the wall. When mounted with the base section 11 flat against the surface S1, the leg 3 extends downwardly and outwardly at an angle to the surface S1 to present the articles in staggered fashion as shown in FIGS. 1 and 3. The upper portion and right hand portion of the articles A are all visible at eye height so that a person can quickly see how many articles are on the display unit and can also see some details of the color of the article and/or its style.

In another embodiment, as shown in FIG. 4, the display unit 1A could have the base 11A aligned with the leg 3A and be bent at 27 to provide a vertical end section 29. The vertical end section 29 is adapted to be mounted in an upright tubular support post 33.

The single-leg display units 1 with the angled base 11 are adapted to be combined to provide various larger display units. For example, a right hand, single-leg, display unit 1B and a left hand single-leg, display unit 1C can be combined to provide a diverging two-leg display unit 35. As shown in FIG. 5, the two display units 1B and 1C have their bases 11B, 11C joined together by a base sleeve 37 while their legs 3B, 3C diverge from each other and their hangers 5B, 5C face each other. Thumb screws 38 or the like can be provided in the base sleeve 37 to lock it onto the bases 11B, 11C. The base sleeve 37 allows the distance between the units 1B, 1C to be varied so that the width of the display unit 35 can be varied. The base sleeve 37 has suitable means for use in mounting the display unit 35 on a vertical surface S2 with the base sleeve horizontal. Alternatively, the two bases 11B, 11C can be joined and made integral to provide a two-leg display unit of fixed size with a common, unitary base (not shown). This display unit is also adapted to be fastened to a vertical surface with the unitary base horizontal.

The two-leg display unit 35, of either fixed or adjustable width, can be provided with mounting means for mounting it on a pegboard. The mounting means can comprise a pair of mounting hooks 39, one of which is shown in FIG. 6, that are fastened to the back 41 of the base 11. Each hook 39 is preferably made from a piece of wire looped double, the wire providing a pair of vertical sections 43 fastened to the back 41 of the base section 11 as shown in FIG. 6. The lower ends of the vertical sections 43 extend below the base section and are joined by a loop 45. A pair of horizontal wire sections 47 extend rearwardly from the top of the vertical sections 43 above the base section 5. The hook 39 includes a pair of mounting wire sections 49 extending up from the horizontal wire sections 47. The mounting wire sections 49 and horizontal wire sections 47 are inserted into holes 51 in a pegboard 53 as shown in FIG. 6 to mount the display thereon. The back 41 of the base 11 of the display unit is parallel to the pegboard 53 while the legs 3 extend downwardly and outwardly from the base 11. While one form of pegboard mounting means has been described others can be used.

One diverging two-leg display unit 35A can be combined with a second, diverging, two-leg display unit 35B to form a four-leg display unit 45, as shown in FIG. 7, particularly when the angle $\phi'$ of the legs 3D, 3E relative to the bases 11D, 11E in unit 35A, and of the legs 3F, 3G to bases 11F, 11G in unit 35B, is 135°. The units 35A, 35B are positioned with adjacent legs 3E, 3F abutting so that the bases 11D, 11E of one unit are at right angles to the bases 11F, 11G of the other unit. The legs 3E, 3F could be joined by bolts or other suitable fastening means (not shown). The free legs 3D, 3G on each unit 35A, 35B could be fastened flat to a common wall surface S3 as shown, by suitable means (not shown) to connect the four-leg unit 45 to the wall. The bases on each unit could be joined by a tubular sleeve, as before, or the bases could be joined to make a unitary base.

Two, four-leg display units 45A, 45B could be combined to form a square display unit 47 with eight legs 3H to 30 as shown in FIG. 8. The display unit 45A has two sub-units 35C, 35D and the display unit 45B also has two sub-units 35E, 35F. Such a display unit 47 could be mounted on a square post P with the base 11H to 11K of each two leg sub-unit 35 as long as one side of the post P. The free legs 3H, 3K on one unit 45A are abutted with the free legs 3L, 3O on the other unit 45B, to form the square display unit 47. The unit 47 is attached to the post with fasteners (not shown) through the bases 11H to 11K. These bases could again be joined in pairs by a base sleeve, or integrally as shown, to provide a fixed length base for each sub-unit. The post P could be mounted on a stand and could be rotatable on the stand to rotate the square display unit 47. While the eight-leg display unit 47 has been described as square, it could also be made rectangular with one of the two-leg sub-units in each four-leg display unit being longer than the other two-leg unit it is combined with.

A left hand, single-leg, display unit 1B' can be combined with a second, right hand, single-leg unit 1C' in back-to-back relationship as shown in FIG. 9 to form a display unit 49. These two units 1B', 1C' are combined with suitable fastening means (not shown) joining the legs 3B', 3C' of the units together, and with their hangers 5B', 5C' extending in opposed directions. The legs 3B', 3C' each extend at an angle of 135° from their respective bases 11B', 11C' . The bases 11B', 11C' form a right angle allowing the unit 49 to be mounted on a right-angle, outer, corner C. When mounted on the corner with suitable fastening means (not shown) one base is fastened to one surface S4 and the other base is fastened to the other surface S5, both surfaces joining to form the corner C. The combined unit 47 extends out a 135° angle to both the surfaces S4 and S5 while also angling downwardly.

A left hand single-leg display unit 1A" with the aligned base 11A" can also be combined with a second, right hand, single-leg, unit 1B" with an aligned base unit 11B" as shown in FIG. 10 to form a display unit 50. The legs 3A", 3B" abut back-to-back and with their hangers 5A", 5B" extending in opposite directions. Preferably, in this embodiment, the legs 3A", 3B" are combined into one integral unit (not shown) as are the bases 11A" 11B" and their vertical extensions 27A", 27B" (not shown). The vertical extensions 27A", 27B are adapted to be mounted in a vertical tubular post 35.

Preferably, in all display units, the article support 9A is adjustable on the hanger arm 5 so it can be located closer to or farther away from the leg 3 depending on the width of the article A being displayed. The article support 9A can have a sleeve 55 at its inner end 57 as shown in FIG. 11, which slides over the hanger arm 5 so the article support can be slid along the hanger arm to adjust its position relative to the arm 5. The top of the sleeve 55 can have a slotted projection 59 to hold a sign relating to the merchandise carried by the article support 9A.

If desired, a plurality of article supports 9B, equally spaced apart, can extend laterally from a long sleeve 55B which sleeve is adapted to be mounted over a hanger arm 5 as shown in FIG. 11A. This arrangement can be used for displaying long narrow articles such as belts or ties. In an alternative arrangement, shown in FIG. 11B, a narrow bar 61 with a short sleeve 55C on its back at its mid-point can be mounted via the sleeve on the arm 5 with the bar 61 adjacent the front face 63 of the arm. A plurality of article supports 9C, equally spaced apart, can extend from the front face 65 of the bar. Projections 67 can be provided at the front, upper ends of the bar 61 for moving the bar relative to the arm 5. The sleeves 55B, 55C in both embodiments can have means at the top, similar to the projection 59 on sleeve 55, for carrying a sign.

Preferably, the hanger arms 5 can be removably and adjustably mounted on the leg 3. To this end, as shown in FIGS. 12 to 15, the side 71 of the leg 3 from which the hanger arms 5 extend can be slotted along its length as shown at 73. The inside of the slot 73 is enlarged as shown at 75, the enlarged portion 75 connected to the side 71 by a narrow gap 77. The bottom end of the slot 73 is closed but its upper end is open allowing the arms 5 to be mounted in the slot. Each hanger arm 5 has a mounting plate 81, the plate 81 joined to one end of the arm 5 by a narrow connector 83 and extending at an angle $\phi$ to the arm. The plate 81 fits snugly within the enlarged portion 75 of the slot 73, the connector 83 extending through the gap 77. Each hanger arm 5 can slide in the slot 73 to position it when the arm 5 is held to take its weight off the plate 81. Once the arm 5 is at the desired position, the arm is released, and it pivots slightly under its own weight to frictionally lock the plate 81 against the walls 85 defining the enlarged portion 75, locking the arm in place. In this embodiment, the arm is angled to the vertical instead of parallel to the vertical. The adjustable arms can be used on all the display units but are especially suitable for display units having back-to-back single-leg units with a common leg. Both sides of the common leg are slotted to receive adjustable arms on each side of the common leg.

The display units, particularly the back-to-back display units, can be mounted on a display stand. As shown in FIGS. 16 and 17, the display stand 101 has an elongated base 103. The base can have a main portion 105 of octagonal shape and a minor portion 107 of generally rectangular shape can extend forwardly from one of the sides 109 of the main portion 105. The base 103 can be equipped with wheels, not shown. A plurality of support posts 111, three of which are shown, are provided with the stand 101. Each post 111 is tubular and of square cross-section and the posts are of the same height. Means are provided for mounting each post 111 by its bottom end 113 on the rear of the base 103. More specifically, the base 103 has a row of holes 115 in the top wall 117 of the base 103, equal in number to the maximum number of posts used, extending along the longitudinal axis "X" of the base 103 and located adjacent the side 119 of the main portion 105 of the base 103 opposite the side 109. The holes 115 are spaced apart slightly more than the width of the posts 111. Each post 111 has a plug 123 at its bottom end 113 with a central threaded hole 127 in the plug. A bolt 129 is provided for each hole 115, the bolt 129 passed upwardly through the top wall 117 of the base 103 through the hole 115 and threading into a plug 123 in a post 111 to tightly connect that post 111 to the base 103 in an upright position. As many posts 111 as required, usually up to six, can be mounted on the base 103, all aligned with the longitudinal axis "X" of the base 103 and located close to one end of the base.

A standard 141 is provided for each post 111 as shown in FIGS. 18 and 19. Each standard has a set of spaced-apart holes 143 through it along its length. The holes 143 are used to adjustably mount the standard 141 in the post 111 from the open end 145 of the post 111. The post 111 has a spring latch 147 adjacent its open end 145, with a pin 149 on the latch 147 entering one of the holes 143 in the standard 141 to lock the standard 141 at the height selected for the standard 141. A number of accessories are provided for the standards 141. The accessories can include small shelves 155; simple supports 157; sign holders 159; and different display units including some of the display units described above. Each accessory has a tubular cap 163 at one end for mounting the accessory on the top of a standard 141. The standards 141 are stored within the posts 111 when not used, just a small portion extending up from the post.

The construction permits, for example, two display units 1A, 1B to be mounted on the front two standards 141A, 141B with the front display unit 1A lower than the top display unit 1B as shown in FIG. 20. The construction of the stand 101 locates the center of the display units 1A, 1B over the longitudinal center line "X" of the base 103 and the elongated base 103 prevents the stand from tipping over. Additional standards could be used with standards 141A, 141B. A third standard 141C for example, located behind the first two standards 141A, 141*b* could hold a shelf to hold more articles to replace those sold from the display units. Alternatively, the third standard could hold a sign 159 above the two display units advertising the articles displayed by the display units. Instead of sign 159, the display units 141A, 141B could have small tubular sign holders (not shown) at the top of the bend 27A, 27B at the rear ends of the legs. One or more standards behind standards 141A, 141B and 141C, if used, could have additional shelves 155 located toward the rear holding more articles to replace those sold from the display units. The standards could also hold simple article supports 157 for displaying more articles to the rear of the stand where space is limited.

The posts 111 are preferably provided with suitable means for detachably connecting them together, in a line, when installed on the base. The connecting means 169 can comprise interlocking slot and tongue elements on adjacent sides of the posts. As shown in FIGS. 21 to 23 each side 171 of a post 111 has a plate 173 adjacent its side separated a short distance from the side by a bottom spacer 175, the plate 173 parallel to the side 171 and forming a slot 177 between it and the side wall 171. The opposite side 181 of each post 111 has a tongue 183 spaced from the side wall 181 by a top spacer 185, the tongue 183 parallel to the side wall 181. When the posts 111 are assembled on the base, the tongue 183 of one post enters the slot 177 on the adjacent post to interlock the posts together against relative longitudinal movement. The tongue 183 can have a short projecting tab 191 and the bottom spacer 175 can have a narrow slot 193 for receiving the tab 191 to interlock the posts against relative lateral movement. As many as posts 111 can be interconnected together as can be mounted on the base 103. The connecting means forms the posts used, no matter the number, into a rigid unit. Other connecting means can be employed in place of the tongue and slot connection.

The use of the posts, the standards, the novel display units, and the accessories, permits the seller to design his stand various ways to sell his products. Many posts can be used, with several of the posts supporting various accessories, or few posts can be used. The arrangement chosen depends on how the seller wishes to display the products.

If desired, the posts 111 can be provided in units or modules of two or three posts each, the two or three posts permanently fixed together side-to-side and with each module having connecting means, similar to the connecting means 169, on their outermost sides. The post modules can be combined with each other or with single posts in various ways, in a straight line, up to the maximum number which can be used on the base. Providing the posts in fixed modules, of two or three to a unit, reduces handling when changing the displays on the stand. When fixed together, the posts in the post modules are preferably spaced apart the same distance that the individual posts are spaced apart when detachable connected to each or to the modules.

What is claimed is:

1. A display unit (1) for displaying articles, the display unit having: a straight leg (3), a base (11); one end (17) of the leg (3) fixed to the base (11); the leg (3) extending downwardly at an acute angle to the base (11) when the base is mounted on a support; a plurality of spaced-apart hanger arms (5) extending laterally from at least one side of the leg; the hanger arms (5) extending at an acute angle to the leg; each hanger arm having an article support extending transversely therefrom to carry the articles to be displayed, the article supports staggered laterally from one another when viewed from the top when the base is mounted on the support.

2. A display unit as claimed in claim 1 wherein the base (11) is horizontal when mounted on the support and the leg (3) extends outwardly from the base (11) at a second angle which is obtuse.

3. A display unit as claimed in claim 2 including mounting means (75, 83) for detachably mounting the arms (5) on the leg (3) so as to be able to change the size and/or the number of the arms and to vary the spacing between the arms.

4. A display unit as claimed in claim 2 including slidable means (55, 55B) for slidably mounting the article supports (9A, 9B) on the arms (5) to be able to adjust their position on the arms.

5. A display unit as claimed in claim 2 wherein the base extends from the same one side of the leg as the hanger arms and is parallel to the hanger arms.

6. A display unit as claimed in claim 2 wherein the leg extends outwardly from the base at a second angle of 135°.

7. A display unit as claimed in claim 1 wherein the base is vertical when mounted on the support and a plurality of spaced-apart hanger arms extend laterally from the other side of the leg, these hanger arms also extending at an acute angle to the leg and having an article support extending transversely therefrom to carry the articles to be displayed, the article supports staggered laterally from one another when viewed from the top when the base is mounted on the support.

8. A display unit having a base, first and second legs attached at one end to the base and extending downwardly from the base at an acute angle when the base is mounted horizontally on a support and the first and second legs diverging away from each other from the base, the first leg having a plurality of spaced-apart hanger arms extending laterally from one side of the leg toward the second leg, the second leg having a plurality of spaced-apart hanger arms extending laterally from one side of the leg toward the first leg.

9. A display unit as claimed in claim 8 wherein each hanger arm has an article support extending transversely therefrom to carry the articles to be displayed, the article supports staggered laterally from one another when viewed from the top when the base is mounted on the support.

10. A display unit as claimed in claim 9 wherein each leg extends at an angle of 135° away from the base in diverging from each other.

11. A display unit as claimed in claim 9 including mounting means for detachably mounting the arms on the legs so as to be able to change the size and or number of the arms and to vary the spacing between the arms.

12. A display unit as claimed in claim 9 including slidable means for slidably mounting the article supports on the arms to be able to adjust their position on the arms.

13. A display unit as claimed in claim 9 wherein the base is in two sections and a connector adjustably connects the sections together so that the distance between the legs can be varied.

14. A display unit as claimed in claim 6 wherein the hanger arms on each leg are parallel to each other, to the base and to the hanger arms on the other leg.

15. A display unit as claimed in claim 8 wherein each leg extends at an angle of 135° away from the base in diverging from each other.

16. A display unit as claimed in claim 8 wherein the base is in two sections and a connector adjustably connects the sections together so that the distance between the legs can be varied.

17. A display stand having: an elongated base; at least two support posts; a plurality of support post mounting means on the base, the mounting means located adjacent one narrow end of the base and parallel with the longitudinal axis of the base, each mounting means used to mount a support post on the base; connecting means for mounting the posts in an upright position on the mounting means on the base; a display unit mounted on at least one of the posts to extend over the base toward the other narrow end of the base; the display unit (1) having; a straight leg (3), a base (11), the base (11) relatively short compared to the length of the leg (3); one end (17) of the leg (3) fixed to the base (11); the leg (3) extending downwardly at an acute angle to the base (11) when the base is mounted on the post; a first set of spaced-apart hanger arms (5) extending laterally from one side of the leg; a second set of hanger arms extending laterally from the other side of the leg, the hanger arms (5) extending at an acute angle to the leg, the acute angles on both sides of the leg being the same; each hanger arm having an article support extending transversely therefrom to carry the articles to be displayed, the article supports staggered laterally from one another when viewed from the top when the base is mounted on a support; and one of a second display unit, identical to the first display unit, and an accessory, mounted on the second support post.

18. A display stand as claimed in claim 17 including connecting means (169) for detachably connecting the posts (111), mounted on the mounting means (115) on the base (101), together to from a single support unit.

19. A display stand as claimed in claim 17 wherein the posts (111) are provided in modules of at least two posts to a module, the posts (111) in each module permanently fixed together; and connecting means (169) on the modules for connecting the modules together and/or with other posts, to form a single support unit with all the posts aligned.

* * * * *